US007874086B2

(12) United States Patent
Briscoe et al.

(10) Patent No.: US 7,874,086 B2
(45) Date of Patent: Jan. 25, 2011

(54) LOCK ASSEMBLY FOR SECURING A WEAR MEMBER TO EARTH-WORKING EQUIPMENT

(75) Inventors: Terry L. Briscoe, Portland, OR (US); Christopher M. Carpenter, Tualatin, OR (US); Aaron B. Lian, Portland, OR (US)

(73) Assignee: Esco Corporation, Portland, OR (US)

( * ) Notice: Subject to any disclaimer, the term of this patent is extended or adjusted under 35 U.S.C. 154(b) by 864 days.

(21) Appl. No.: 11/789,801

(22) Filed: Apr. 24, 2007

(65) Prior Publication Data

US 2008/0263913 A1 Oct. 30, 2008

(51) Int. Cl.
*E02F 9/28* (2006.01)

(52) U.S. Cl. ..... 37/455; 37/456; 172/772.5; 172/753; 403/374.1; 403/379.4; 403/321

(58) Field of Classification Search ..... 37/446–460; 172/772, 772.5, 701.1–701.3, 719, 753; 403/374.1, 403/379.4, 379.2, 321, 322.4, 324
See application file for complete search history.

(56) References Cited

U.S. PATENT DOCUMENTS 2,435,846 A * 2/1948 Robertson ..... 37/454
2,912,774 A * 11/1959 McCrary ..... 172/777
3,341,253 A * 9/1967 Hostetter ..... 299/10
3,413,739 A * 12/1968 Guinot ..... 37/455
4,413,432 A * 11/1983 Bierwith ..... 37/456
4,433,496 A * 2/1984 Jones et al. ..... 37/456
5,088,214 A 2/1992 Jones
5,241,765 A 9/1993 Jones et al.
5,244,047 A 9/1993 Eudy
5,311,681 A * 5/1994 Ruvang et al. ..... 37/457
5,491,915 A * 2/1996 Robinson ..... 37/458
5,564,508 A * 10/1996 Renski ..... 172/772
5,666,748 A 9/1997 Emrich et al.
6,491,469 B1 * 12/2002 Pasqualini et al. ..... 403/318
6,826,855 B2 * 12/2004 Ruvang ..... 37/450
6,993,861 B2 2/2006 Carpenter et al.
7,367,144 B2 * 5/2008 Jones et al. ..... 37/456
7,526,886 B2 * 5/2009 McClanahan et al. ..... 37/457
7,536,811 B2 * 5/2009 McClanahan ..... 37/455
2003/0024139 A1 * 2/2003 Jones et al. ..... 37/456

* cited by examiner

*Primary Examiner*—Thomas A Beach
(74) *Attorney, Agent, or Firm*—Steven P. Schad

(57) ABSTRACT

A locking assembly for retaining a wear member to excavating equipment has a locking element that is received into an opening in the assembly and is movable about a pivot axis in the opening between a hold position and a release position. The locking element has an outer edge that is generally opposite the pivot axis that opposes a base surface of the opening when the locking element is in the hold position. The outer edge is configured to pull away from the base surface when the locking element is rotated from the hold position toward the release position.

22 Claims, 11 Drawing Sheets

LOCK ASSEMBLY FOR SECURING A WEAR MEMBER TO EARTH-WORKING EQUIPMENT

FIELD OF THE INVENTION

The present invention pertains to a lock assembly for securing a wear member to earth-working equipment.

BACKGROUND OF THE INVENTION

Wear parts are commonly attached to all kinds of earth-working equipment to prolong the useful life of the equipment. For example, teeth are mounted along the digging edge of various kinds of excavating equipment, runners are mounted along buckets and chutes, hammers are mounted in crushers, etc. Such wear parts typically comprise multiple components such as a base fixed to the equipment, a wear member mounted over the base, and a lock to releasably hold the wear member to the base. In this way, the material to be discarded due to wear can be minimized.

Wear parts for earth-working equipment are subjected to harsh conditions and, in some cases, heavy loading. In order to provide the desired strength and tightness in the assembly, the lock is frequently driven into and out of the assembly with a large hammer. Although hammered locks have long been in use, they are difficult to use and can expose the worker to potential hazards. Efforts have been made to develop hammerless locks, particularly for the large mining machines. As one example, U.S. Pat. No. 6,993,861 discloses a tapered lock that is pried into and out of a cooperatively tapered opening, and offers many benefits over hammered locks. Nevertheless, in some environments, release of the latch can be resisted by impacted fines.

SUMMARY OF THE INVENTION

The present invention pertains to an improved lock assembly for securing wear members to earth-working equipment, which is hammerless, easy to use, readily manufactured, strong, stable, and able to reduce the problems associated with impacted fines.

In accordance with one aspect of the invention, the lock assembly includes a locking element which turns about an axis between a retaining position and a release position. The locking element is coupled to a base structure such that its outer edge swings into space previously occupied by the locking element when turned to its release position. In this way, the resistance of impacted fines is alleviated. The lock, then, is easy to use and manipulate for those in the field when the wear members need replacing.

In another aspect of the invention, the locking element includes a cavity for receiving a tool by which a user can release a keeper, turn the locking element to the release position, and/or remove the lock from the wear assembly.

In another aspect of the invention, the lock is operable between release and hold positions without the need for a hammer for increased safety and ease of use.

DETAILED DESCRIPTION OF THE PREFERRED EMBODIMENTS

Figure 1:
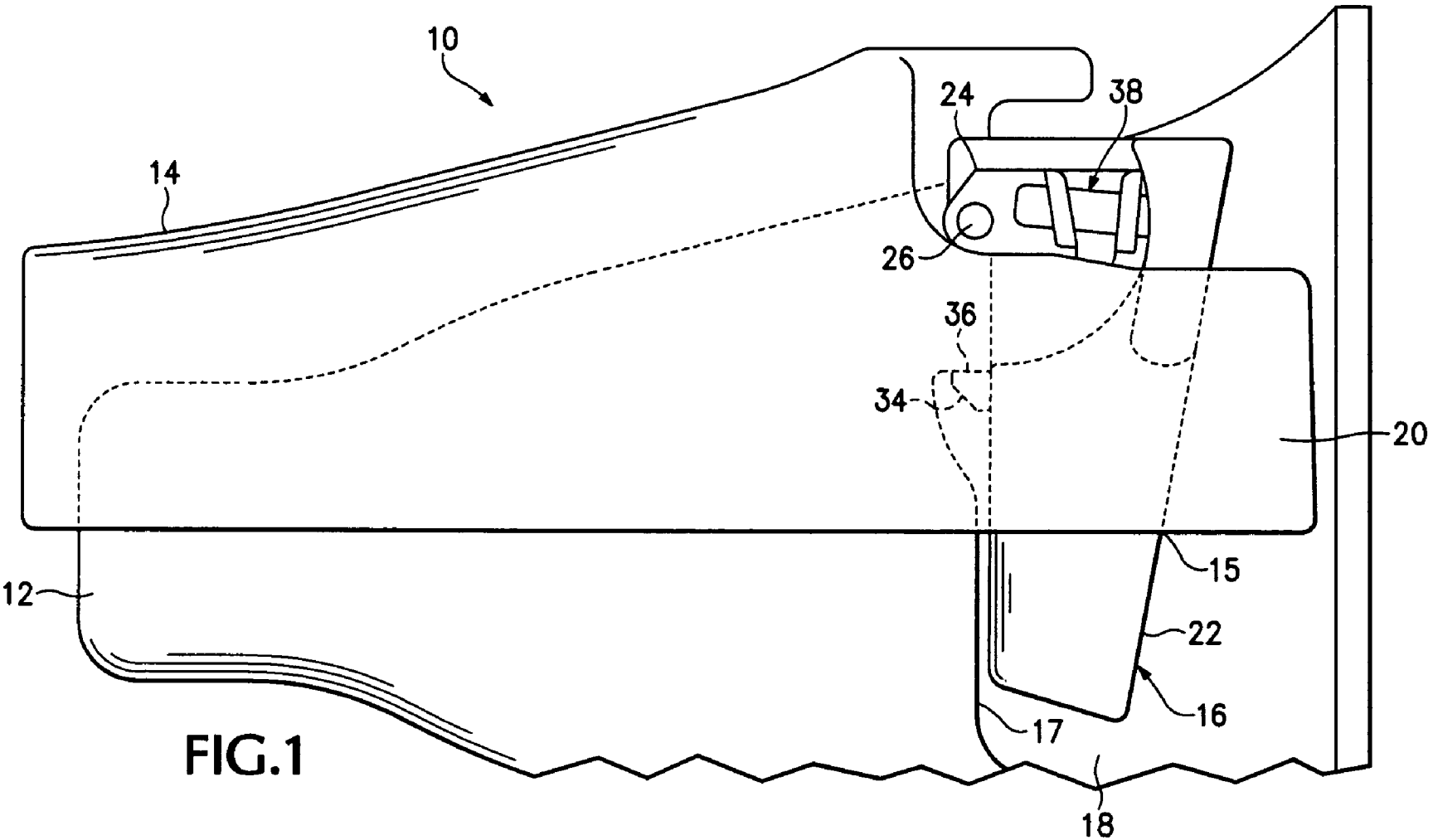
FIG. 1 is a partial side view of a wear assembly with a lock in accordance with the present invention.

The present invention pertains to a lock assembly for releasably attaching a wear member to earth-working equipment such as excavating buckets, dredge cutters, ore chutes, crushers or the like. For convenience, in this application, the invention is described in the context of securing a point to a nose to form an excavating tooth for a bucket. However, lock assemblies in accordance with the present invention can secure a wide array of wear members (e.g., shrouds, wear caps, runners, hammers, etc.) which are attached to virtually all kinds of earth-working equipment. Moreover, relative terms such as forward, rearward, up or down are used for convenience of explanation with reference to FIG. 1; other orientations are possible.

Wear assembly 10 is shown as an excavating tooth with a nose 12, a wear member or point 14, and a lock 16 to releasably hold the point to the nose (FIGS. 1-5). Nose 12 may be cast as part of the lip or may be part of an adapter fixed to the lip by welding or mechanical attachment. The illustrated nose and point are formed as described in U.S. Pat. No. 6,993,861, hereby incorporated by reference, with a tapered cavity 18 for receiving the lock. Point 14 includes a side ear 20 with an inward lug (not shown) to define an opening 15. When the components are assembled together, opening 15 cooperates with an opening 17 defined as a side relief in nose 12 to collectively define a cavity 18 for receiving lock 16. While this kind of locking arrangement external of the nose is preferred, a lock in accordance with the present invention could also be used in a tooth where the lock cavity extends vertically or horizontally through the body of the nose.

Figure 3:
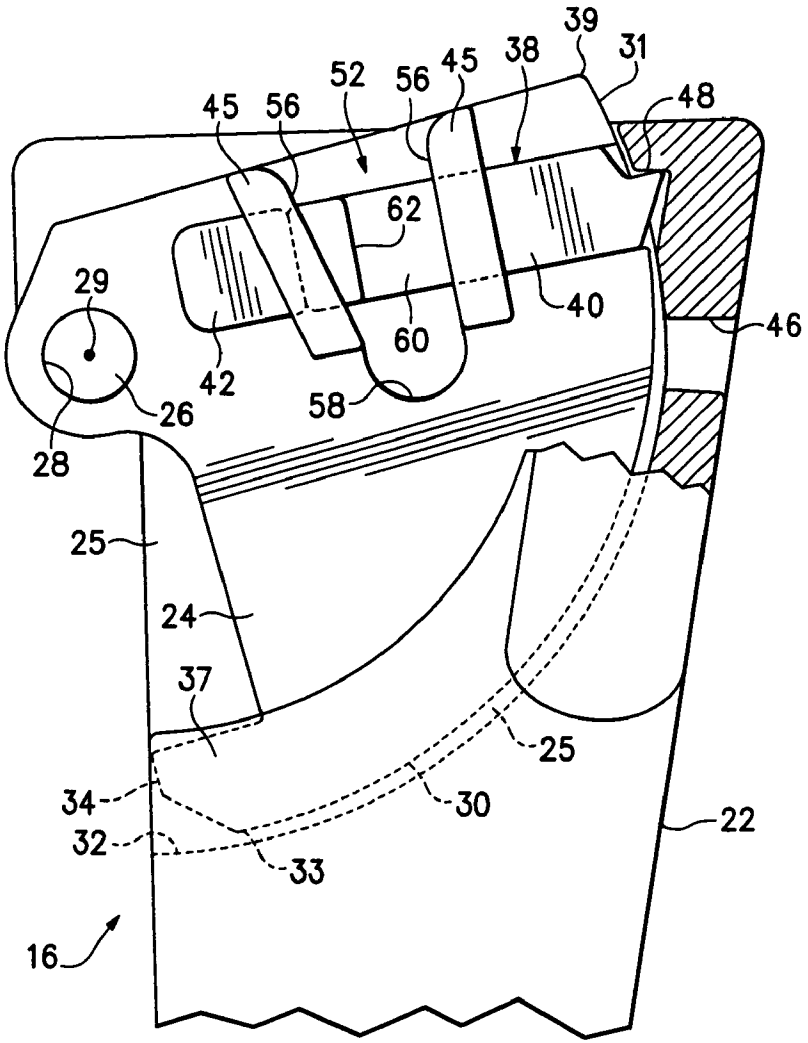
FIG. 3 is a partial side view of the lock with the locking element in the release position.
Figure 2:
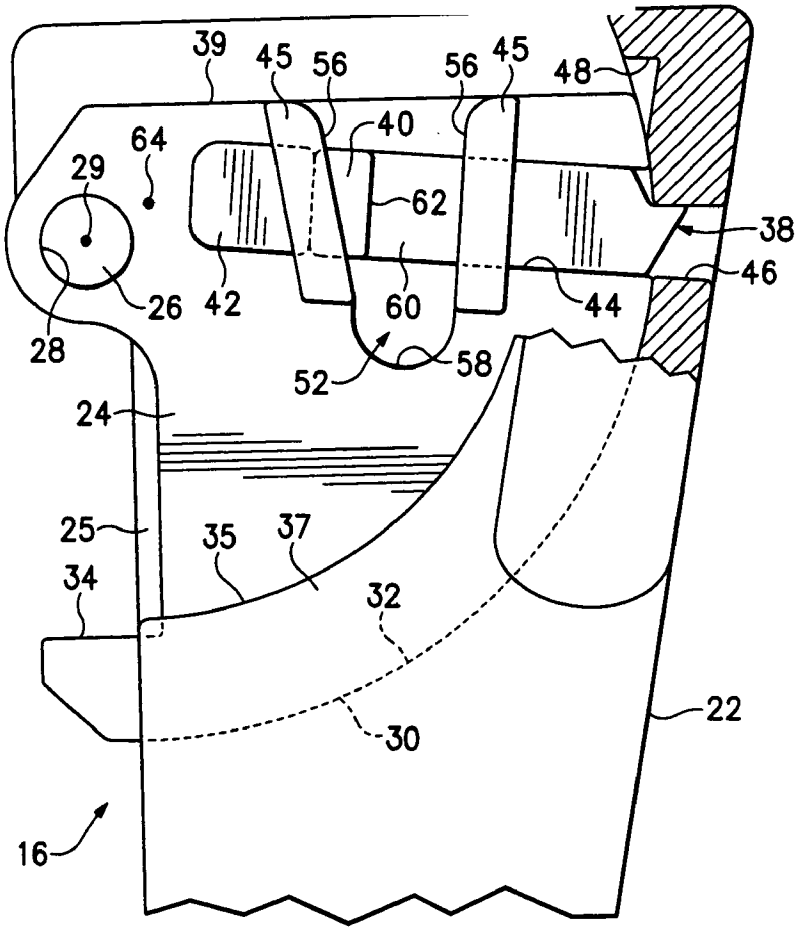
FIG. 2 is a partial side view of the lock with the locking element in locked position.
Figure 5:
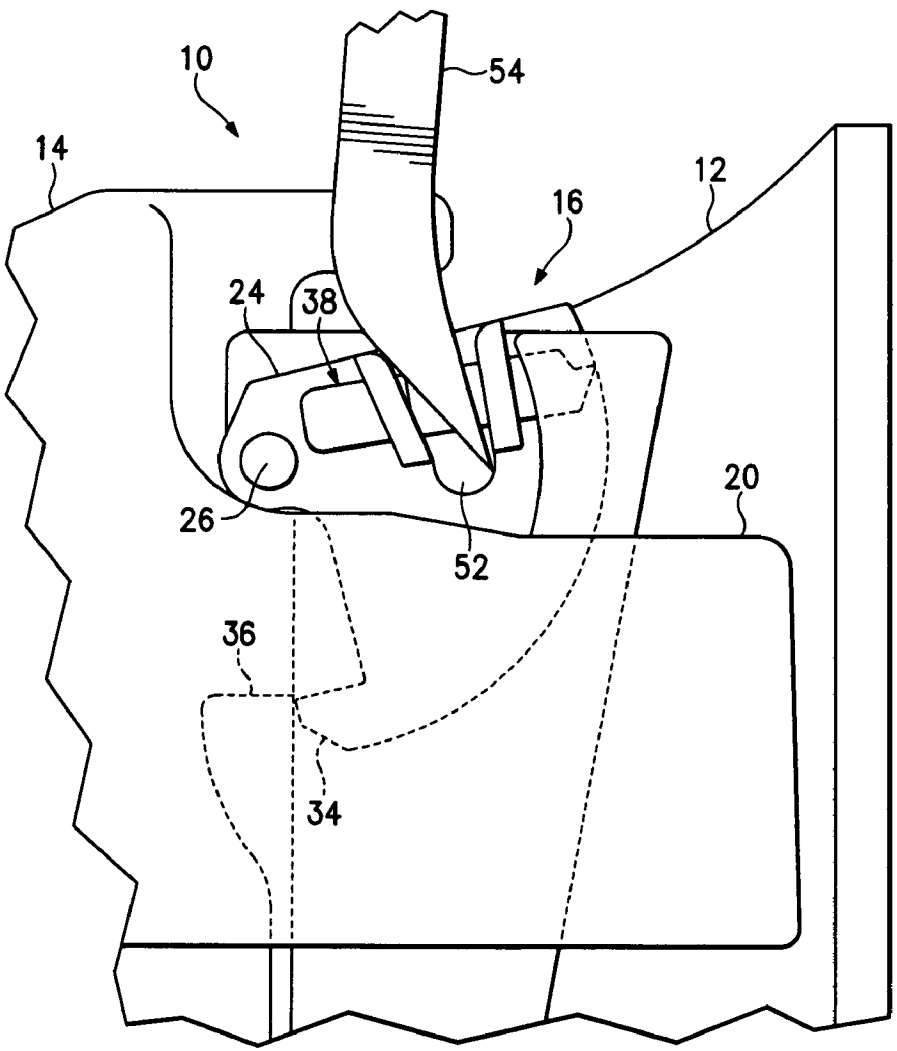
FIG. 5 is a partial side view of the wear assembly with the removal tool moving the locking element to the release position.

Lock 16 includes a body 22 having a tapered width and/or thickness for mating receipt into passage 18 (FIGS. 2 and 3). As described in U.S. Pat. No. 6,993,861, this tapering of the body enables the lock to be pried into and out of the cavity without the use of a hammer. While a hammerless operation is preferred, the inventive concepts could be used in a lock having a body that does not taper and/or a lock that requires hammering. Lock 16 also includes a rotating locking element 24 in the form of a latch received in a cavity 25 formed in body 22. In this embodiment, locking element 24 is secured to body 22 via shaft 26 received in hole 28 for turning about axis 29. The locking element, then, turns about shaft 26 between the retaining position (FIG. 2) and the release position (FIG. 3). A finger 34 of the locking element extends to project beyond body 22 in the retaining position so as to engage a stop 36 formed in point 14 (or nose 12) and thereby hold the lock in cavity 18. A curved outer edge 30 of locking element 24 (i.e., the side opposite the axis of rotation defined by shaft 26 extending from top wall 39 to leading end 31) sets within a channel 35 and against seat 32 in the locked condition. Seat 32 provides support to locking element 24 during use and reduces the bending stress on shaft 26. Channel 35 is defined by an upstanding flange 37 on body 22. In a preferred construction, channel 35 and locking element 24 are tapered such that they diverge in a direction generally toward pivot axis 64. As a result, the sides of the locking element and channel do not engage until locking element is fully seated to ease turning of the locking element.

Figure 6:
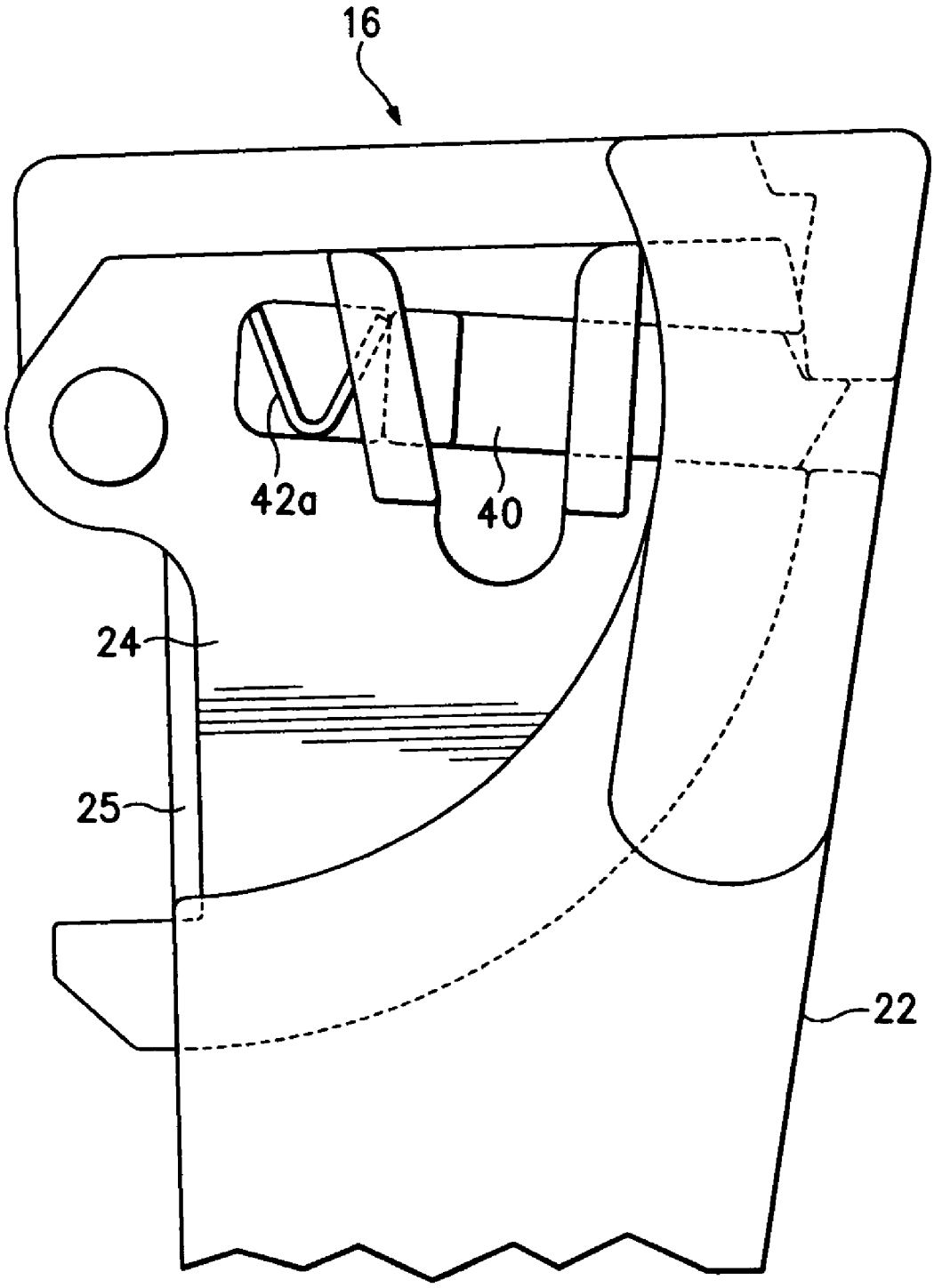
FIG. 6 is a partial side view of a second embodiment of the lock.

Locking element 24 preferably includes a keeper 38 for releasably securing the locking element in the locked and/or release positions. Keeper 38 preferably includes a rigid contact element 40 formed of steel or other hard material, and a resilient biasing member 42 composed of rubber, foam or other resilient material. Biasing member 42 could also be a metallic spring 42a such as shown in FIG. 6. Keeper 38 sets within a closed slot 44 in locking element 24 bounded by braces 45 for linear movement between an extended position and a retracted position. As shown in FIG. 2, biasing member 42 ordinarily presses contact element 40 rearward and into a first index opening 46 formed in body 22. In this position, keeper 38 prevents the locking element from turning and holds finger 34 against stop 36. Keeper 38 can, however, be shifted forward to release index opening 46 and permit turning of the locking element to the release position (FIG. 3). The keeper may engage a second index opening 48 to secure the locking element in the release position (i.e., with finger 34 retracted) or simply remain unengaged with a locking structure in the release position. Additionally, locking element 24 is preferably held by keeper 38 in second index opening 48 in the release position for shipping and installation of the lock.

Figure 4:
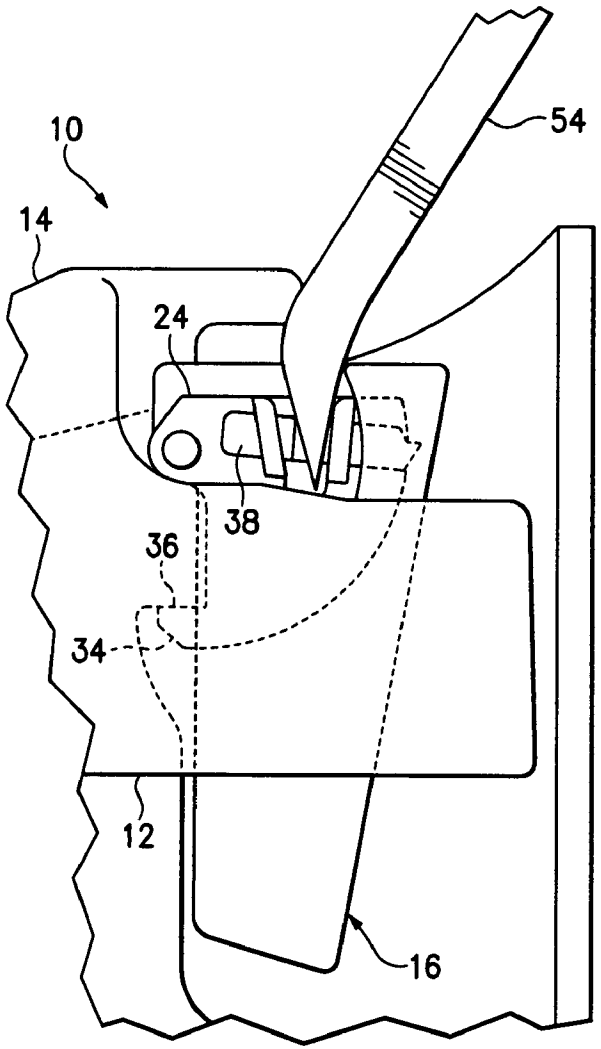
FIG. 4 is a partial side view of the wear assembly with a removal tool.

In a preferred construction, locking element 24 includes a tool cavity 52 for receiving the end of a pry tool 54 to effect release of keeper 38 and turning of the locking element. Tool cavity 52 preferably has narrowing sidewalls 56 that terminate in a generally circular end 58, but could have other shapes. Tool cavity 52 is generally aligned with a notch 60 in the contact element 40 of keeper 38. To remove lock 16 from cavity 18, tool 54 is inserted into tool cavity 52 such that it passes through notch 60 (FIG. 4). The tool is swung (FIG. 5) so that it presses against a sidewall 62 of notch 60 and moves contact element 40 against the bias of resilient member 42 until keeper 38 is removed from index opening 46. Continued swinging of tool 54 then pries lock 16 from cavity 18 at least until it is loosely contained in cavity 18.

Although locking element 24 turns about shaft 26, the outer edge 30 is not defined by a radius of curvature originating at the shaft. Rather, outer edge 30 is defined by a radius of curvature originating from an origination point 64 that is offset from the axis of rotation 29 defined by shaft 26 so that outer edge 30 pulls away from seat 32 when it rotates to its release position. Of course, other shapes besides a radius could define the outer edge. As illustrated in FIG. 2, origination point 64 is offset rearward and upward relative to axis 29 of shaft 26. As discussed above, it is common for earthen fines to become impacted in all spaces in and around the lock during use. If outer edge 30 were defined to generally follow the swinging of the component (i.e., be defined by a radius of curvature originating from axis 29), impacted earthen fines between the two walls 30, 32 would hinder turning of locking element 24 and the removal of lock 16. In many environments, the impacted fines become hard and make turning of locking element 24 difficult if outer edge 30 follows seat 32 during turning of the locking element. By designing outer edge 30 to pull away from seat 32, the outer edge is pulled into open space previously occupied by the locking element itself and free of earthen fines. Hence, the problem of impacted fines is alleviated once initial release of the locking element is accomplished.

As noted above, outer edge 30 of locking element 24 preferably sets against seat 32 in the locked condition for support. Nevertheless, the problem of impacted fines remains, even if a gap exists between the outer edge and the seat in the locked condition; i.e., if a gap exists between the locking element 24 and the base structure 22, earthen fines will tend to fill the gap. Hence, irrespective of whether the seat abuts outer edge 30, it is beneficial for the outer edge to swing into space previously occupied by the locking element itself. When installing lock 16 into cavity 18, the pry tool can again be inserted into tool cavity 52 and swung in the opposite direction to pry the lock into its fully seated position where keeper 32 engages first indexing opening 46.

In an alternative embodiment (FIGS. 7-11), wear assembly 80 includes a nose 82, a wear member 84, and a locking element 86 in the form of a lock for the wear assembly. This tooth is formed as described in Provisional Patent Application No. 60/787,268, which is hereby incorporated by reference, but could have other constructions as well. Point 84 includes an opening 85 in the form of a through-hole that generally aligns with an opening 87 in nose 82 defined as a trough to define a cavity 89 for receiving locking element 86.

Figure 7:
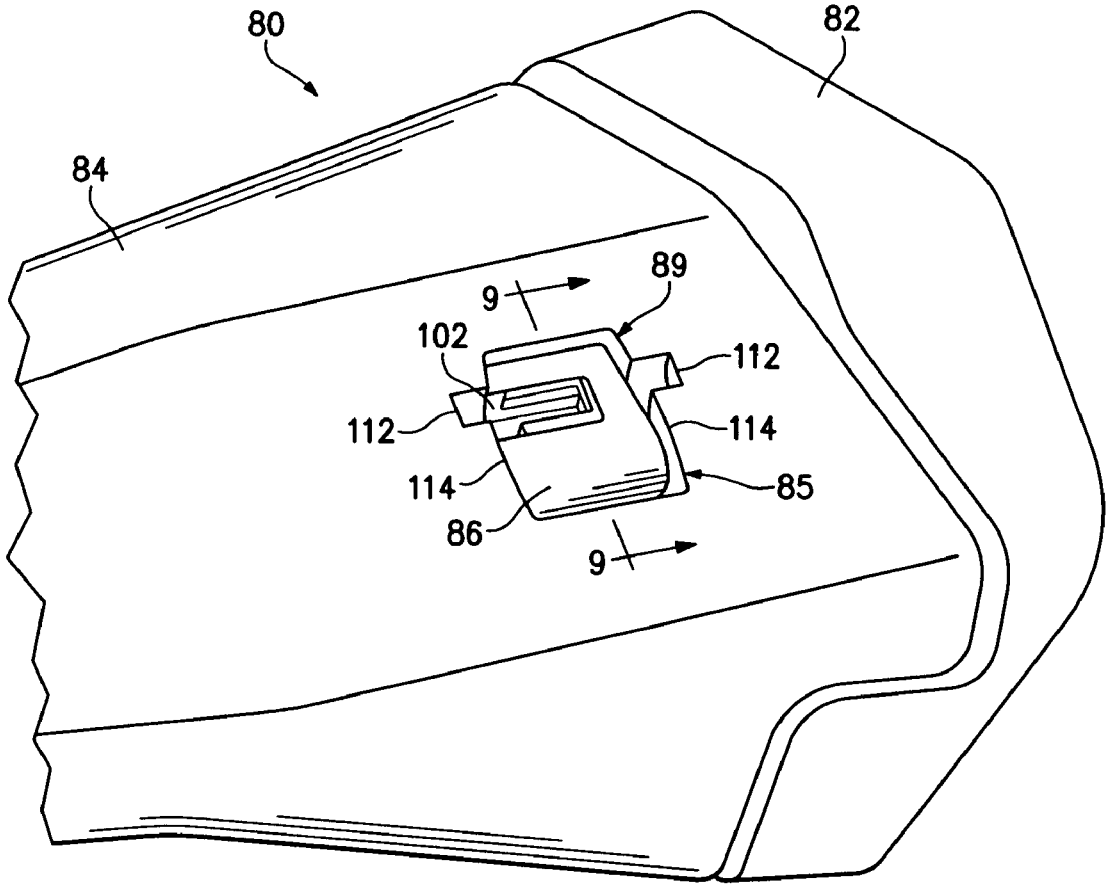
FIG. 7 is a partial perspective view of a wear assembly with a third embodiment of a lock in accordance with the present invention.

Locking element 86 includes a keeper 90 that is similar in construction and operation to keeper 38. Locking element 86 includes a pair of lateral shafts 92 about which the locking element turns between its locked and release positions. Opening 85 includes a pair of arcuate channels 112 in opposing walls 114 for receiving shafts 92. In use, locking element 86 is inserted into opening 85 such that shafts 92 are moved to the closed end of channels 112. In this position, locking element 86 can be swung about shafts 92 between the release position (FIG. 8) and the locked position (FIG. 7). In the locked position, locking element 86 projects into trough 87 to prevent removal of point 84 from nose 82. Keeper 90 is biased to engage stop 100 and hold the locking element in place.

Keeper 90 includes a contact element 94 formed of steel or other hard material and a resilient biasing member 96 to normally bias contact element out of locking element 86. Contact element 94 is formed to engage a stop 100 formed in point 84 (or nose 82) in the locked position so as to retain locking element 86 in assembly 80. A tool cavity 102 is formed in locking element 86 to receive a pry tool 54 to release keeper 90 and turn locking element 86 to its release position. As with keeper 38, contact element 94 is formed with a notch 104 generally aligned with cavity 102. The pry tool 54 can be inserted into cavity 102 and notch 104 and swung to release keeper 90 from stop 100, and then, turn locking element 86 about shafts 92 to place locking element 86 in its release condition.

Figure 8:
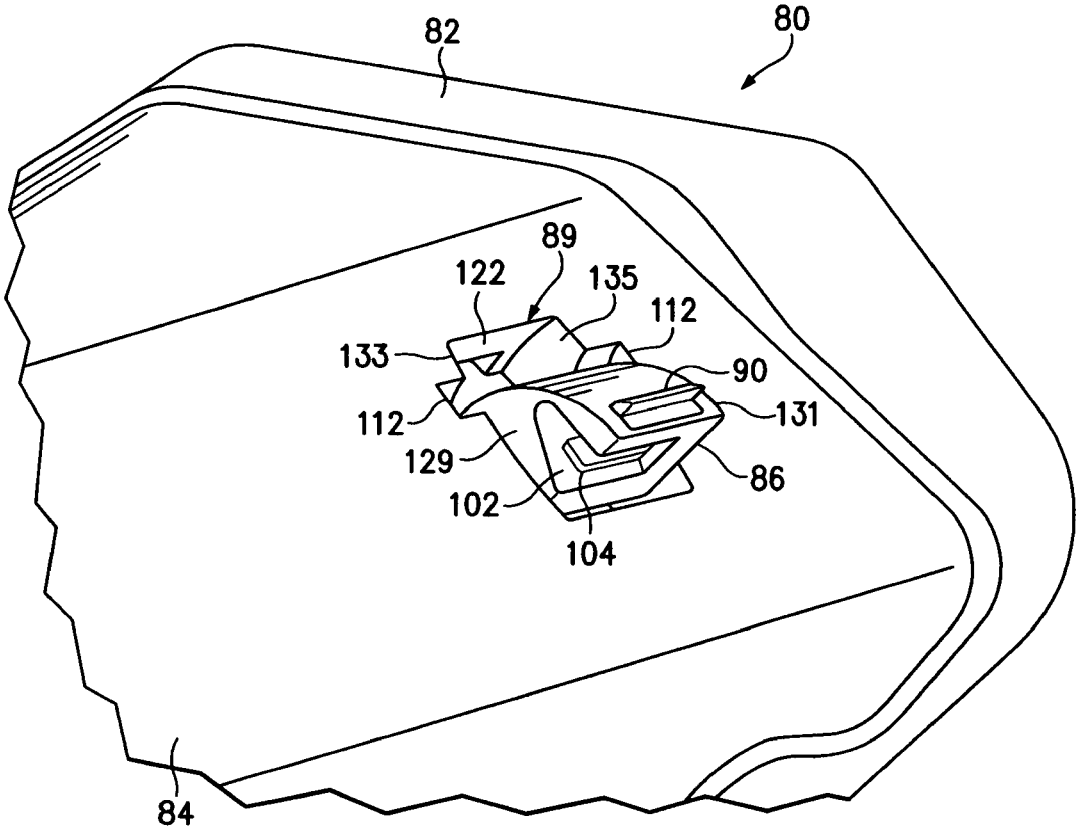
FIG. 8 is a partial perspective view of the wear assembly of FIG. 7 with the lock in the release position.
Figure 9:
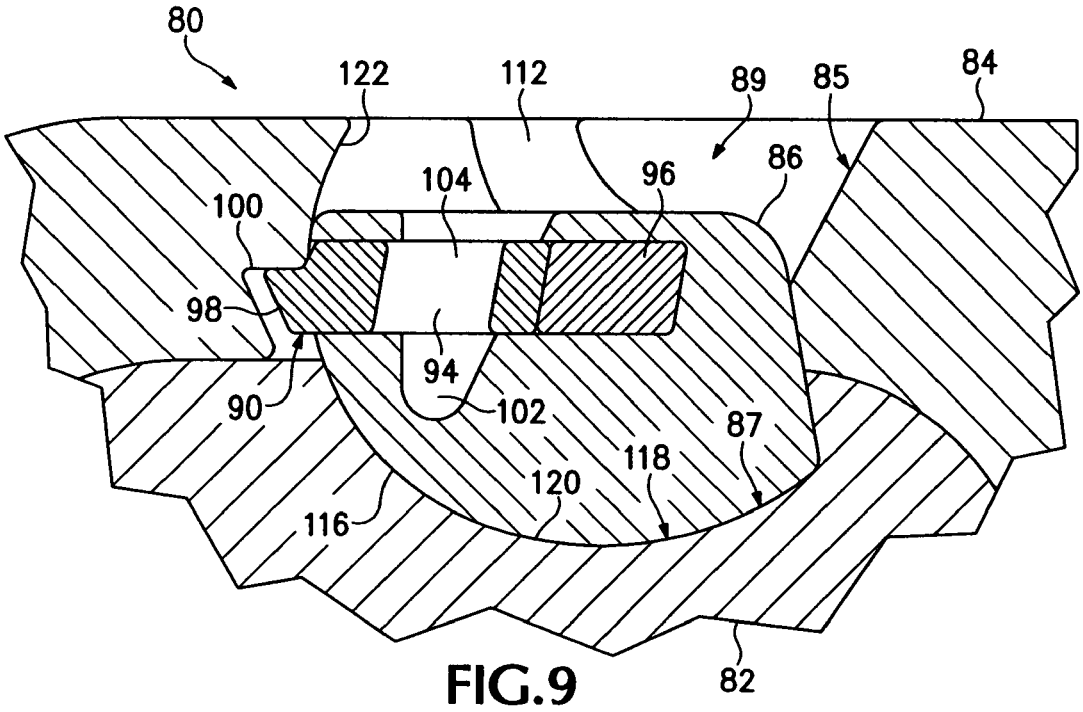
FIG. 9 is a cross-sectional view taken along line 9-9 in FIG. 7.
Figure 10:
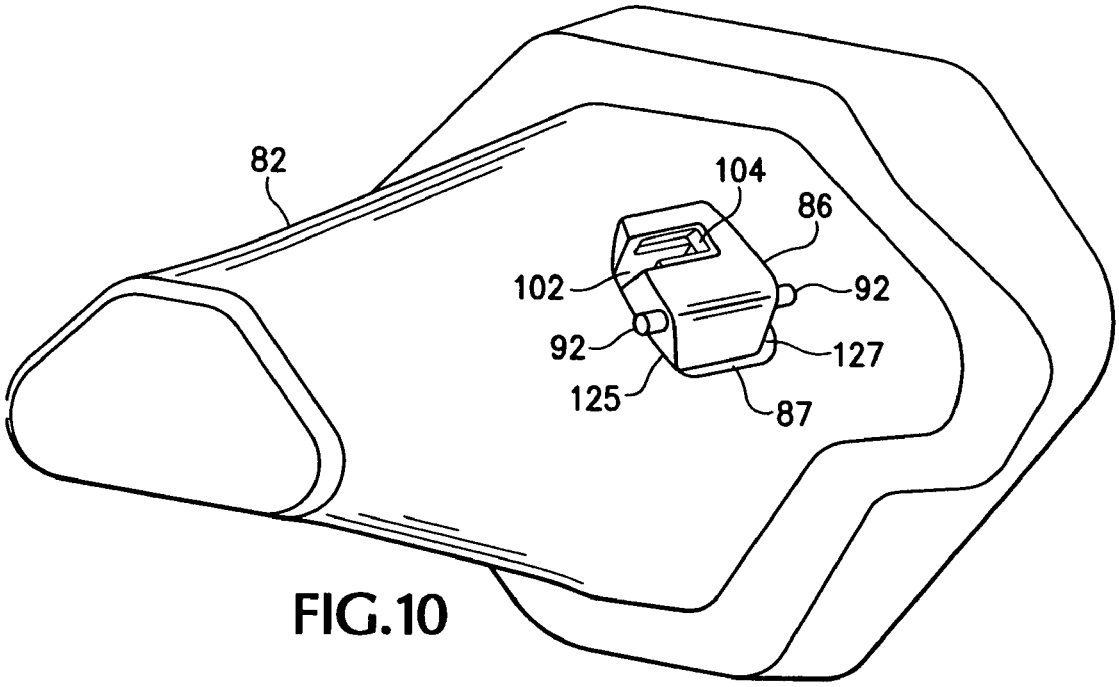
FIG. 10 is a perspective view of the nose and lock of the wear assembly of FIG. 7.
Figure 11:
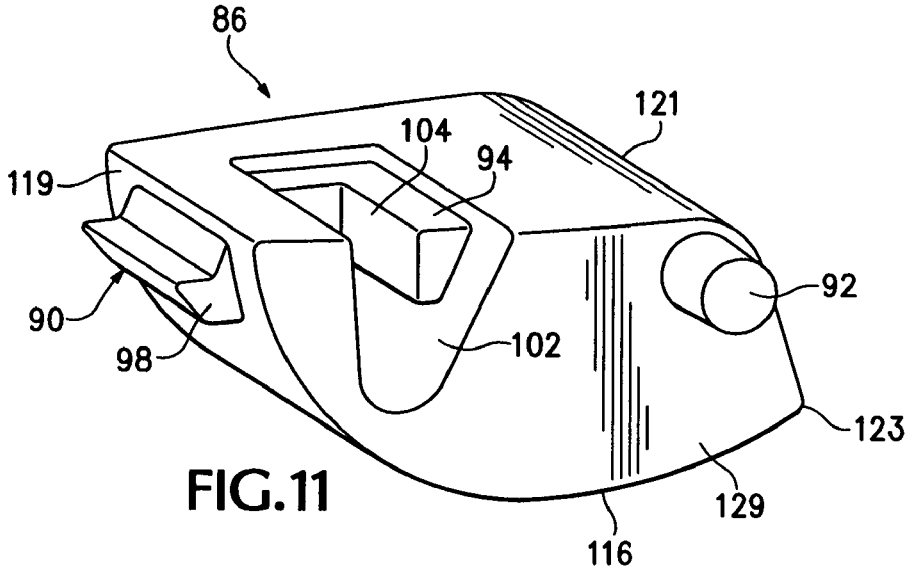
FIG. 11 is a perspective view of the lock in FIG. 7.
Figure 12:
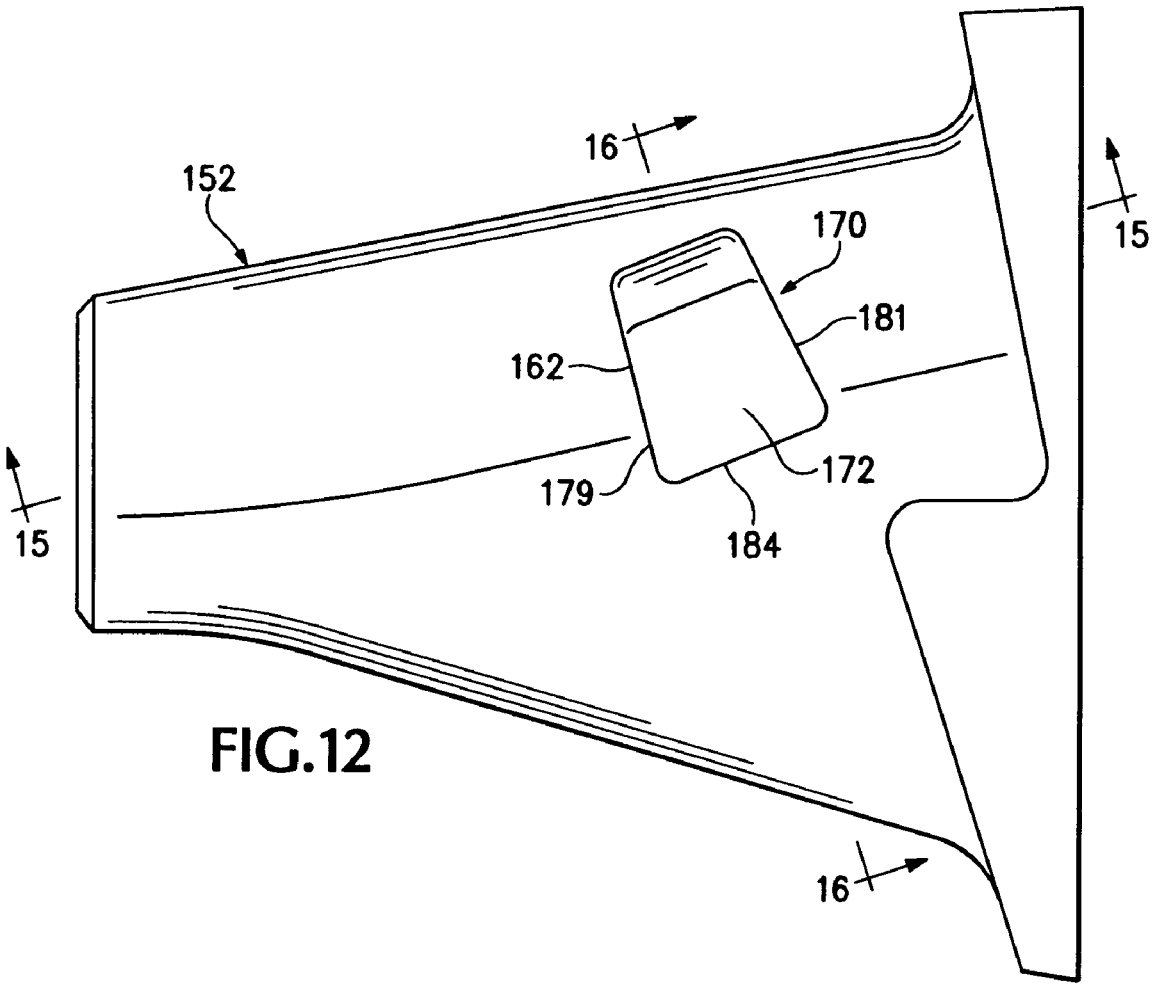
FIG. 12 is a side view of a nose of a fourth embodiment of the invention.
Figure 13:
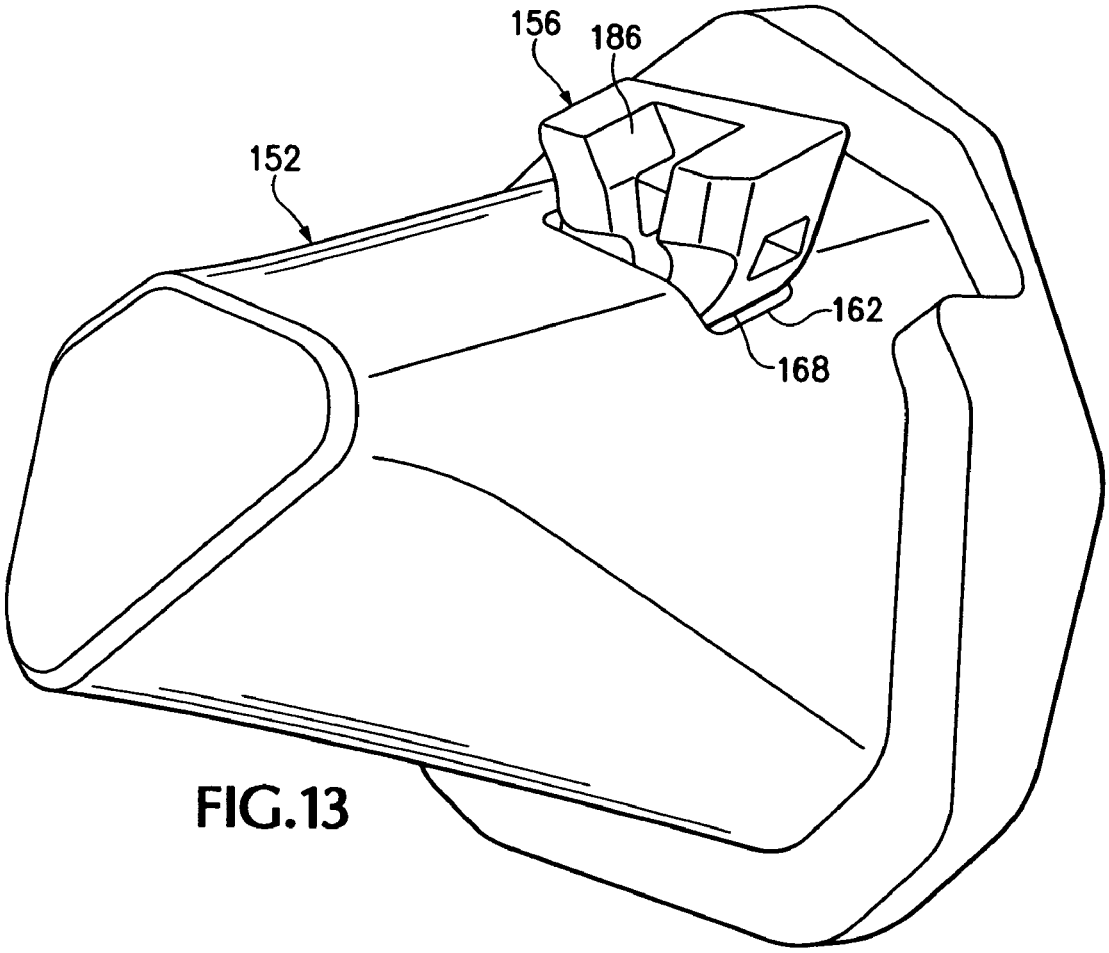
FIG. 13 is a perspective view of the nose and a lock (with the keeper omitted) in accordance with the fourth embodiment of the invention.

Locking element 86 includes a curved outer edge 116 that extends from a trailing end 119 at top wall 121 to leading end 123. In the hold position, outer edge 116 sets against a seat 118 collectively defined by the base 120 of trough 87 and a sidewall 122 of through-hole 85. To release point 84, pry tool 54 is inserted into cavity 102 and notch 104 and swung to shift contact element 94 against the bias of resilient member 96 to release stop 100. Continued swinging of the pry tool, turns locking element 86 about shafts 96 from the locked condition (FIG. 7) to the release condition (FIG. 8). In the same way as outer edge 30 of locking element 24 pulls away from seat 32 and into space previously occupied by the locking element, outer edge 116 of locking element 86 pulls away from seat 118 as locking element 86 turns about shafts 92. The origination point for the radius of curvature defining outer edge 116 is offset from the axis 124 extending through shafts 92. As a result, impacted earthen fines do not hinder turning of locking element 86 after its initial release.

Also, as with locking element 24, locking element 86 preferably has a tapered construction such that the front and rear walls 129, 131 diverge generally from outer edge 116 toward shafts 92. The front and rear walls 125, 127 of trough 87 also has a complementary tapering so that front and rear walls 129, 131 of locking element 86 are spaced from front and rear walls 125, 127 of trough 87 until the locking element is fully set against seat 118.

FIGS. 12-16 illustrate an alternative embodiment that is similar to the embodiment of FIGS. 7-11. Tooth 150 has a nose 152 and point 154 which also has a construction generally as described in U.S. Patent Application 60/787,268, although other tooth constructions could be used. A locking element 156 is received in a cavity 158 collectively defined by a through-hole 160 in point 154 and a trough 162 in nose 152. Also, as with locking element 86, locking element 156 operates to hold point 154 to nose 152. However, locking element 156 does not include pivot shafts for controlling the movement of the locking element between its locking and release positions.

Figure 14:
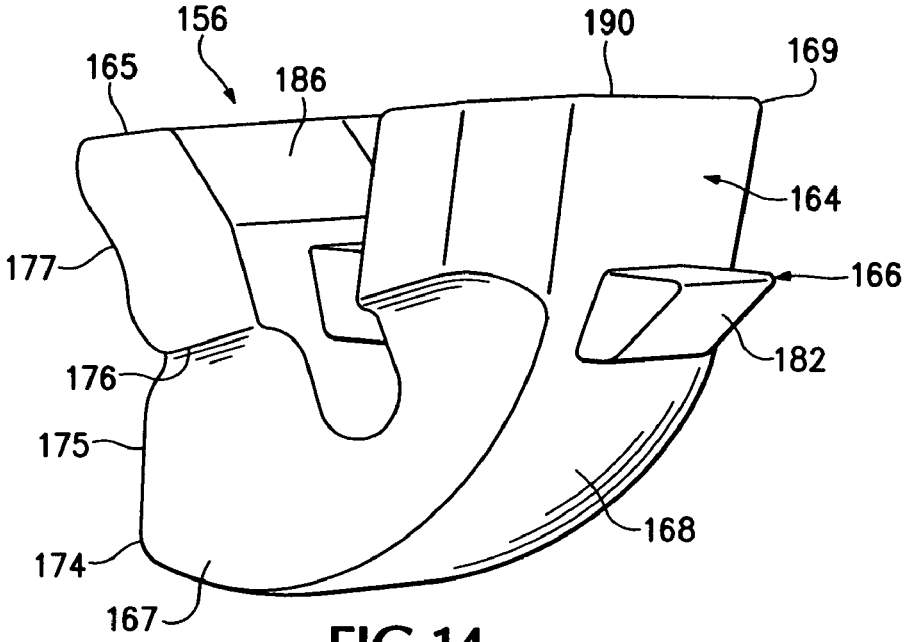
FIG. 14 is a perspective view of the lock of the fourth embodiment of the invention.
Figure 15:
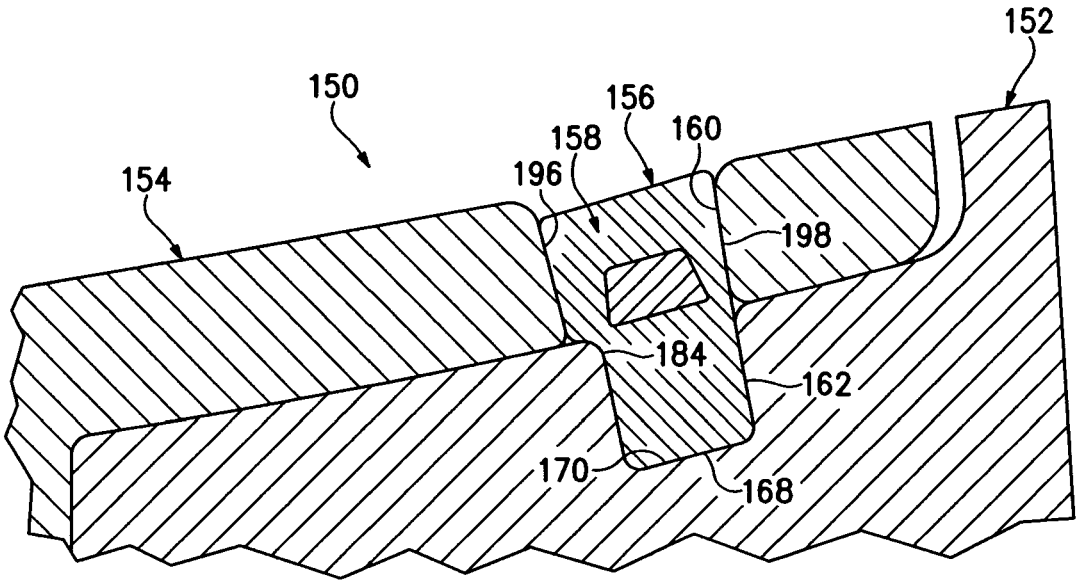
FIG. 15 is a cross-sectional view of the wear assembly of the fourth embodiment taken generally along line 15-15 in FIG. 12.
Figure 16:
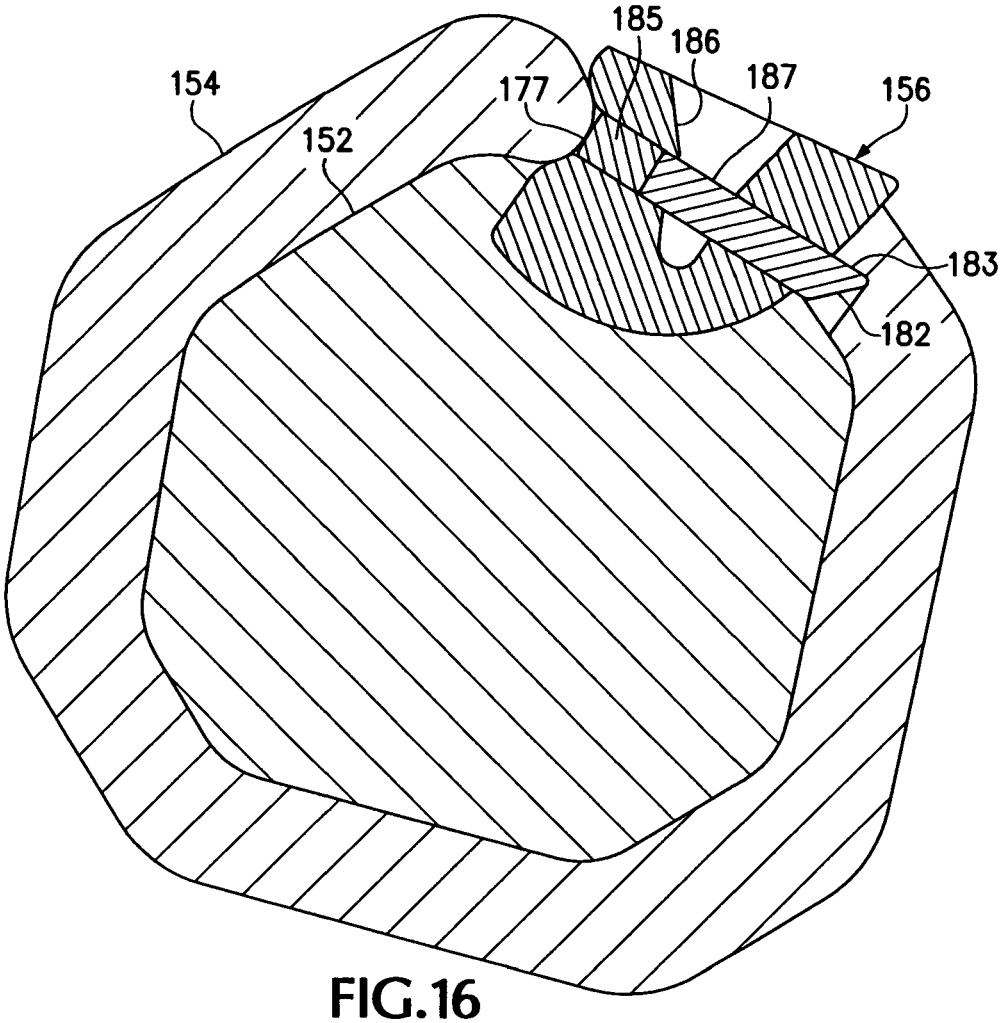
FIG. 16 is a cross-sectional view of the wear assembly of the fourth embodiment taken generally along line 16-16 in FIG. 12.

Locking element 156 includes a top wall 165, front wall 167, rear wall 169 and a rounded outer edge 168 (FIG. 14). Outer edge 168 extends from a trailing end 190 at top wall 192 to leading end 174 and sets against seat 170 defined by the base surface 172 of trough 162 and a side 173 of through-hole 160 in the hold position (FIGS. 15 and 16). The rounded outer edge terminates at a leading end 174. A base wall 175 extends between outer edge 168 and top wall 165, and defines a fulcrum 177 about which locking element 156 turns between the locked condition (FIGS. 15 and 16) and a release position (not shown). Also, in view of the absence of pivot shafts, locking element 156 preferably includes a shoulder 176 that overlies nose 152 forward of trough 162 for support and stability, and to resist twisting, when in the locked condition. Shoulder 176 also substantially lengthens the bearing portion of front wall 167 that contacts nose 152 to better resist the loads applied to point 154 (FIG. 15). Of course, other means of stabilizing the locking element could be used.

Front and rear walls 167, 169 of locking element 156 preferably diverge slightly as they extend radially from top wall 165 to outer edge 168. Likewise, front and rear walls 179, 181 of trough 162 have a complementary construction such that the opening 184 of trough 162 is slightly narrower (i.e., axially) than base surface 172. In this way, trough 162 forms a channel or path through which locking element 156 moves as it turns about fulcrum 177. Trough walls 179, 181 also function to hold locking element 156 during use and prevent its ejection out of cavity 158.

In use, a keeper 166 engages a stop 183 formed in through-hole 160 (or on nose 152) to hold the locking element in cavity 158 in the hold position (FIG. 16). Keeper 166 includes a contact element 182 formed of steel or other hard material and a resilient biasing member 185 to normally bias contact element 182 outward for engagement with the stop (FIGS. 14-16). A tool cavity 186 is formed in locking element 156 to receive a pry tool 54 to release keeper 166 and turn locking element 156 to its release position. As with keeper 38, contact element 182 is formed with a notch 187 generally aligned with tool cavity 186. The pry tool 54 can be inserted into tool cavity 186 and notch 187 in contact element 182, and swung to release keeper 166 from stop 183, and then, turn locking element 156 about fulcrum 177 to place locking element 156 in its release condition (i.e., where locking element 156 is removable from cavity 158).

FIGS. 17-20 are schematic illustrations of the locking concepts in accordance with the present invention in a generic environment (i.e., the concepts of the invention are usable in connecting virtually any wear member in an earth-working environment to its base), but do not illustrate an actual locking assembly. Locking element 130 includes an outer edge 134 that sets against seat 136 in the locked condition. The outer edge 134 is shaped to pull away from seat 136 when the locking element is rotated to its release condition. While the outer edge is preferably defined as a circular arc having a radius of curvature with an origination point offset from the axis of rotation, it could have a different, non-circular shape so long as it moves into space previously occupied by the locking element when the locking element is moved to its release position. As discussed above, it is not essential for the outer edge to set against a seat. Moreover, it is also not essential to the invention to include various features disclosed above, such as keepers, as noted in the above embodiments.

Figure 17:
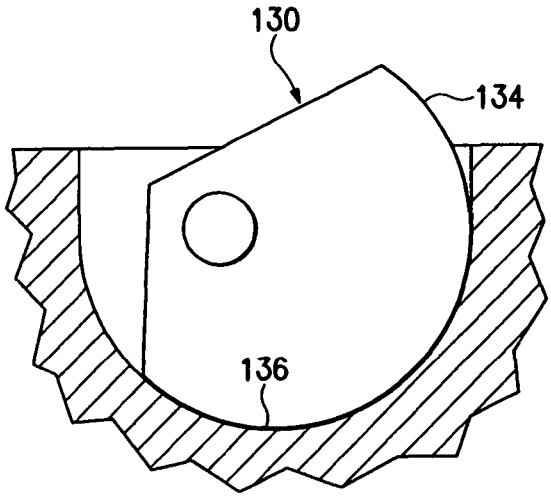
FIG. 17 is a schematic cross-sectional view of a lock arrangement received into an assembly in the locked condition.
Figure 19:
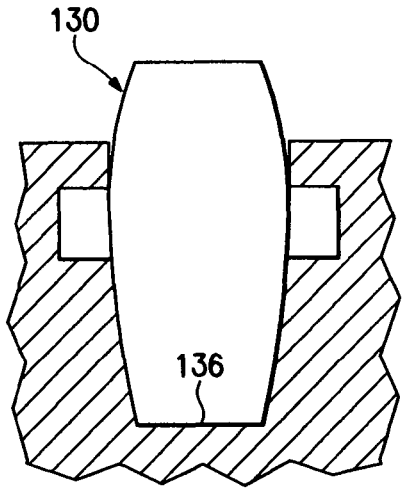
FIG. 19 is a schematic top view of the lock arrangement of FIG. 17 in the locked condition.
Figure 18:
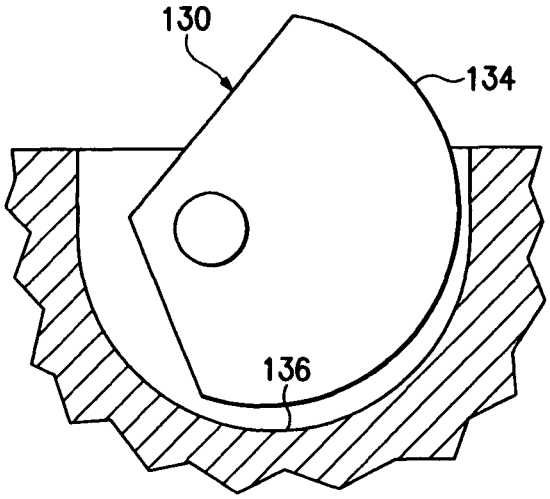
FIG. 18 is a schematic cross-sectional view of the lock arrangement of FIG. 17 received into an assembly in the release condition.
Figure 20:
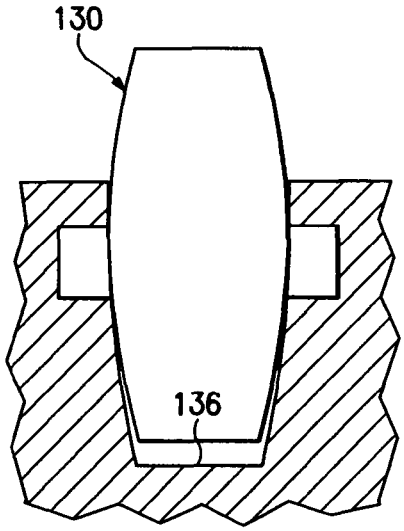
FIG. 20 is a schematic top view of the lock arrangement of FIG. 17 in the release condition.

As shown in FIGS. 19 and 20, locking element 130 is also tapered along its outer edge 134 in generally the same manner as discussed above with locking elements 24, 86, 156. That is, locking element narrows along outer edge 131 as it extends from its outer corner 133 to its opposing inner corner 135 (FIG. 17). Likewise, the sides 137, 139 of the cavity 141 have a complementary narrowing. With this additional tapering, the outer edge of the locking element is free of contact with the seat and impacted earthen fines in essentially all directions after initial movement from its locked position. As a result, release of the locking element is made easier. The concepts of the present invention are beneficial to virtually any lock which uses a rotating locking element to secure a wear member to earth-working equipment where earthen fines may present a problem to removal of the lock.

The invention claimed is:

1. A locking assembly for excavating equipment comprising:

a base having an opening and a base surface within the opening; and a locking element received into the opening and including a pivot member defining a pivot axis about which the locking element rotates between a hold position and a release position, and an outer edge generally opposite the pivot member that opposes the base surface when the locking element is in the hold position, the outer edge being defined relative to the pivot axis such that the outer edge pulls away from the base surface to create a gap along the entire base surface between the outer edge and the base surface when the locking element is rotated from the hold position toward the release position.

2. A locking assembly in accordance with claim 1 wherein the base is a lock body for securing a wear member to the excavating equipment, and the locking element is a latch that retains the lock body in place in the hold position and permits removal of the lock body in the release position.

3. A locking assembly in accordance with claim 2 wherein the base includes a pivot shaft, and the pivot member is a hole in which the pivot shaft is received.

4. A locking assembly in accordance with claim 2 wherein the locking element further includes a finger for engaging a stop in the hold position to retain the lock body in place.

5. A locking assembly in accordance with claim 2 wherein the locking element further includes a keeper for retaining the locking element in the hold position.

6. A Locking assembly in accordance with claim 5 wherein the keeper includes a contact member for engaging a stop and a resilient member for urging the contact member to project outward.

7. A locking assembly in accordance with claim 6 wherein the locking element includes a cavity and the keeper includes an access opening generally aligned with the cavity, the cavity and the access opening receiving a tool for moving the contact member of the keeper to a retracted position against the urging of the resilient member and moving the locking element from the hold position to the release position with a single insertion of the tool into the locking element.

8. A locking assembly in accordance with claim 1 wherein the base is a component of a wear assembly adapted to secure a wear member to the excavating equipment, and the locking element is a lock that releasably retains the wear member to the base.

9. A locking assembly in accordance with claim 8 wherein the pivot member is at least one laterally extending pivot shaft.

10. A locking assembly in accordance with claim 8 wherein the locking element further includes a keeper for retaining the locking element in the hold position.

11. A locking assembly in accordance with claim 10 wherein the keeper includes a contact member for engaging a stop and a resilient member for urging the contact member to project outward.

12. A locking assembly in accordance with claim 11 wherein the locking element includes a cavity and the keeper includes an access opening generally aligned with the cavity, the cavity and the access opening receiving a tool for moving the keeper to a retracted position against the urging of the resilient member and moving the locking element from the hold position to the release position with a single insertion of the tool into the locking element.

13. A locking assembly in accordance with claim 8 wherein the locking element includes front and rear bearing surfaces that generally diverge from each other as they extend generally toward the outer edge.

14. A locking assembly in accordance with claim 8 wherein the locking element includes front and rear walls, and the front wall includes a shoulder adapted to contact an exterior surface of the base forward of the opening to stabilize the locking element.

15. A locking assembly for excavating equipment comprising:

a base having an opening defined by a base surface and at least one side surface; and a locking element received into the opening, the locking element including a pivot member defining a pivot axis about which the locking element rotates in the opening between a hold position and a release position, an outer edge generally opposite the pivot member that opposes the base surface when the locking element is in the hold position, and a pair of outer walls extending generally transverse to the pivot axis, at least one of the outer walls opposing the at least one side surface of the base when the locking element is in the hold position, and at least one of the outer edge and one of the outer walls being configured to pull away from the opposing one of the base surface and side surface of the base to create a gap along at least one of (i) the entire base surface between the outer edge and the base surface and (ii) the entire side surface between said at least one of the outer walls and said at least one side surface when the locking element is moved from the hold position toward the release position.

16. A locking assembly in accordance with claim 15 wherein the outer edge and the outer wall are each configured to pull away from the opposing one of the base surface and side surface of the base when the locking element is rotated from the hold position toward the release position.

17. A locking assembly in accordance with claim 15 wherein the two outer walls each oppose a side surface of the opening, and are each configured to pull away from the opposing side surface when the locking element is moved from the hold position toward the release position.

18. A locking assembly in accordance with claim 15 wherein the base is a lock body for securing a wear member to the excavating equipment, and the locking element is a latch that retains the lock body in place in the hold position and permits removal of the lock body in the release position.

19. A locking assembly in accordance with claim 15 wherein the base is a component of a wear assembly adapted to secure a wear member to the excavating equipment, and the locking element is a lock that releasably retains the wear member to the base.

20. A locking element for a wear assembly for excavating equipment, the locking element comprising a body, a pivot member defining a pivot axis about which the body rotates between a hold position and a release position, and an outer edge along the body adapted to set against a complementary base surface, the outer edge generally being opposite the pivot member and having a convex curve defined by a radius of curvature which has an origination point that is offset from the pivot axis such that when the locking element rotates about the pivot member from the hold position toward the release position the outer edge pulls away from the base surface to create a gap along the entire base surface between the outer edge and the base surface.

21. A locking element in accordance with claim 20 wherein the locking element is a latch that retains a lock in a wear assembly in the hold position and permits removal of the lock from the wear assembly in the release position.

22. A locking element in accordance with claim 20 wherein the locking element is a lock that retains a wear member to the base.

* * * * *